United States Patent [19]

Dutt

[11] Patent Number: 5,020,682

[45] Date of Patent: Jun. 4, 1991

[54] CLOSURE SYSTEM

[75] Inventor: Herbert V. Dutt, Sarasota, Fla.

[73] Assignee: Continental Plastics, Inc., Tridelphia, W. Va.

[21] Appl. No.: 431,204

[22] Filed: Nov. 3, 1989

[51] Int. Cl.[5] ..... B65D 55/02

[52] U.S. Cl. ..... 215/253; 215/216; 215/217

[58] Field of Search ..... 215/214, 252, 203, 250, 215/221, 201, 216, 217, 330

[56] References Cited

U.S. PATENT DOCUMENTS

| | | | |
|---|---|---|---|
| 2,092,547 | 9/1937 | Allenbaugh . | |
| 2,414,420 | 1/1947 | Sebell . | |
| 2,921,705 | 1/1960 | Dorsey . | |
| 3,435,978 | 4/1969 | Wittwer | 215/217 |
| 3,445,022 | 5/1969 | Cilluffo | 215/216 |
| 3,610,454 | 10/1971 | Malick . | |
| 3,776,406 | 12/1973 | Milbourne, Sr. | 215/9 |
| 3,979,001 | 9/1976 | Bogert | 215/217 |
| 4,032,028 | 6/1977 | Reiss et al. . | |
| 4,053,077 | 10/1977 | DeFelice | 215/217 |
| 4,093,096 | 6/1978 | Augros | 215/330 |
| 4,153,174 | 5/1979 | Keller | 215/252 |
| 4,197,955 | 4/1980 | Luenser . | |
| 4,289,248 | 9/1981 | Lynn . | |
| 4,372,456 | 2/1983 | Guala . | |
| 4,530,438 | 7/1985 | McDevitt . | |
| 4,534,477 | 8/1985 | Laub, III . | |
| 4,718,567 | 1/1988 | La Vange | 215/216 |
| 4,723,669 | 2/1988 | Barriac | 215/206 |
| 4,892,208 | 1/1990 | Sledge | 215/216 |

*Primary Examiner*—Stephen Marcus
*Assistant Examiner*—Venessa M. Roberts
*Attorney, Agent, or Firm*—Richard V. Westerhoff; David V. Radack

[57] ABSTRACT

A closure system comprising a container having a neck with external threads thereon and a cap having an end wall, an annular skirt and a dispensing opening extending through the end wall. The skirt has internal threads complimentary to the external threads on the container neck for selectively screwing the cap onto the container neck. Cooperating locking members are provided on the outer surface of the container neck and on the inner surface of the skirt, the locking members preventing rotation of the cap. In one embodiment, a tear out section is provided on the cap skirt which is torn when an attempt is made to unscrew the cap from the container. In another embodiment of the closure system, the locking members are used in association with a non-cylindrical container and a non-cylindrical cap to position the dispensing opening relative to the container in a predetermined position.

24 Claims, 5 Drawing Sheets

CLOSURE SYSTEM

BACKGROUND OF THE INVENTION

1. Field of the Invention

This invention relates to a closure system including a container and a cap, the closure system having interengaged locking members which not only prevent unscrewing of the cap on the container neck when the cap is fully screwed on the neck but which also position the cap relative to the container in a predetermined position. The invention also includes a tamper evident tear out section which will give a visual indication of an attempt to unscrew the cap from the container.

2. Background Information

It is well known to provide closures for containers. One type of commonly used closure consists of a cap having a dispensing opening and a hinged lid. The cap is typically provided with internal threads which engage external threads on the container neck to allow the closure to be screwed onto the container. In use, the hinged lid is pivoted away from the cap to expose the dispensing opening, thus allowing the contents of the container to be dispensed.

It is also well known to provide closures having tamper evident means which provide a visual and mechanical indication that the container has been opened or tampered with. Some of these closures are provided with tamper evident means which are actuated by attempting to unscrew the cap from the container. See, e.g., U.S. Pat. Nos. 2,414,420; 4,197,955; and 4,372,456.

U.S. Pat. No. 4,534,477 discloses a childproof of bottle. The bottle and cap are provided with a gap near the lower end of the thread in the cap and a projection on the outer surface of the container neck. A "flag" springs outward into a gap in the threaded cap when an attempt is made to unscrew the cap. The flag is torn off by continued unscrewing of the cap. This provides a visual indication of tampering with the container.

U.S. Pat. No. 4,289,248 provides a container closure assembly having intermediate positioning means. The closure assembly has detent means for positive positioning of the closure with respect to the container at a preselected intermediate position between full closure-container cooperation and non-cooperative relationship.

Despite these devices, there remains a need for a closure system that locks the cap onto the container neck and which provides a visual indication of any attempt to unscrew the cap from the container. Also, there remains a need for a closure system associated with a non-cylindrical cap and a non-cylindrical container which has locking members that position the dispensing opening relative to the container in a predetermined position.

SUMMARY OF THE INVENTION

The invention satisfies the above-described needs. The tamper evident and locking closure system provides a container having a container neck with external threads thereon and a cap having an end wall, an annular skirt extending from the end wall and a dispensing opening extending through the end wall. The skirt includes internal threads complimentary to the external threads on the container neck for selectively screwing the cap onto the neck. The closure system further includes cooperating locking members on the outer surface of the container neck and on the inner surface of the skirt. These locking members not only define substantially axially extending engagement surfaces that are engaged when the cap is fully screwed on the container, but also prevent rotation of the cap when an attempt is made to unscrew the cap from the container neck. The tamper evident aspect of the invention includes a tear out section on the cap skirt to which the locking member on the cap skirt is secured and which is torn by the locking member on the inner surface of the cap when an attempt is made to unscrew the cap from the container neck after the cap is fully screwed on the container neck. In this way, a visual indication of the attempt to unscrew the cap from the container is provided.

In another embodiment, the closure system comprises a container having a cylindrical neck with external threads and a container body which is non-cylindrical about the longitudinal axis of the container neck and a cap which is non-cylindrical about its longitudinal axis. The cap has an end wall, an annular skirt extending from the end wall, and a dispensing opening extending through the end wall. The cap skirt has internal threads complimentary to the external threads on the container neck for selectively screwing the cap onto the container neck. This closure system further includes locking members as were described hereinabove which have the purpose of not only preventing unscrewing of the cap from the container but which also position the dispensing opening relative to the container in a predetermined position.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENT

Figure 1:
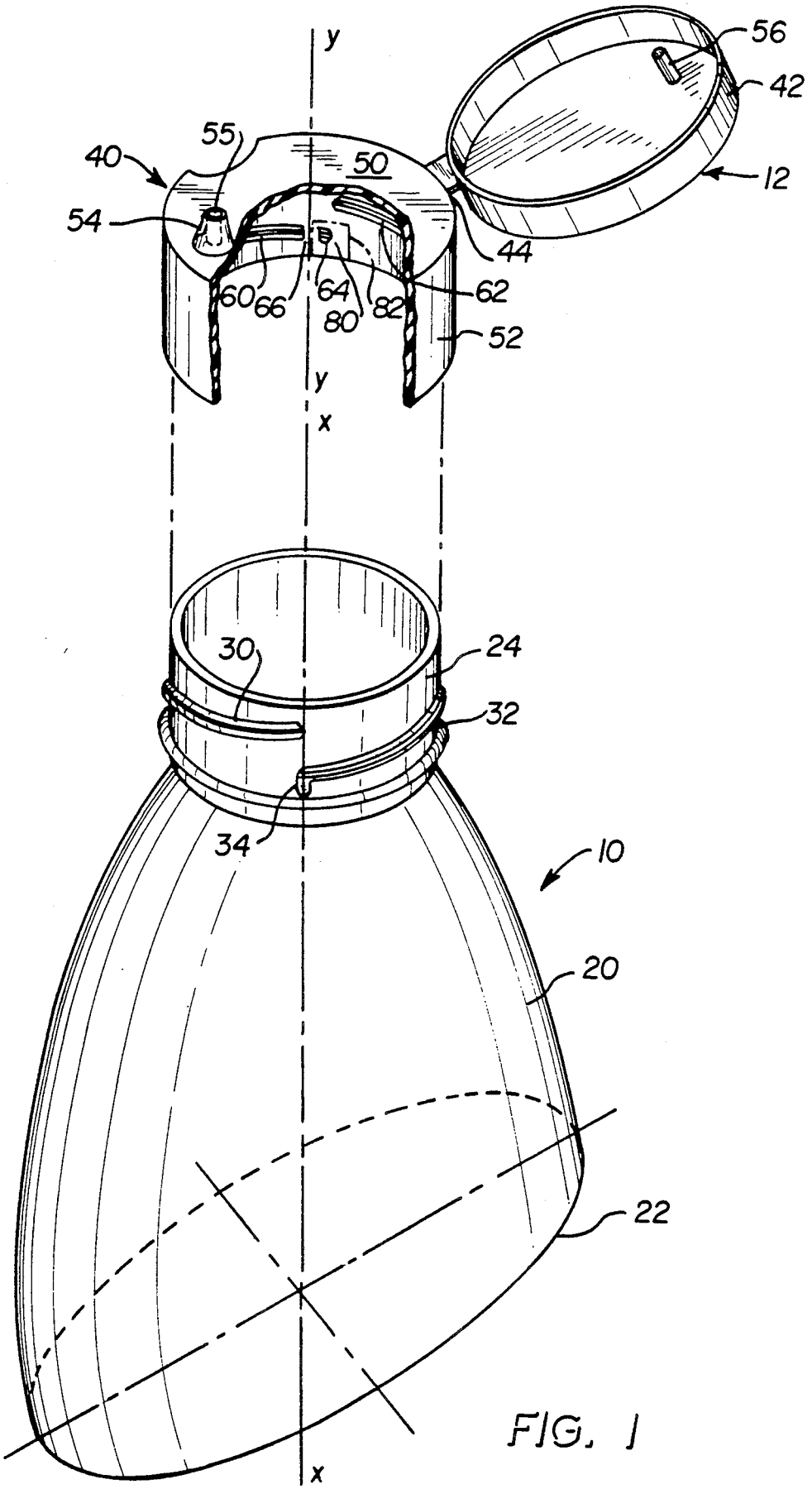
FIG. 1 is an exploded isometric view, partially in section, of the closure system of the invention.

Referring to FIG. 1, the container 10 and closure 12 of the invention are shown. The container 10 consists of a body 20 having an oval shaped base 22 and a cylindrical neck 24. The container body 20 is non-cylindrical about the longitudinal axis x—x of the container neck 24. The container 10 and the closure 12 can be made of a suitable thermoplastic material, such as by way of example only, polypropylene, high density polyethylene, low density polyethylene, polyethylene terephthalate (PET) or polyvinyl chloride.

The container neck 24 has external threads 30 and 32 in its outer surface. These threads 30 and 32 are preferably 180° helical threads which will be complimentary to the internal threads on the closure 12. Thread 32 has an integral downwardly projecting hook 34 which forms part of the locking member of the invention. Although projecting hook 34 is shown integral with thread 32, it will be appreciated that the locking member of the invention will operate whether or not hook 34 is integral to thread 32. The locking member could be provided on both threads 30 and 32. The locking member aspect of the invention will be discussed in detail hereinbelow.

The closure 12 consists of a cap 40 and a lid 42 which is hingedly connected to the cap 40 by hinge 44. The cap 40 has an end wall 50, an annular skirt 52 extending from the end wall 50 and a dispensing opening 54 extending through the end wall 50. A spout 55 is provided on dispensing opening 54. The lid 42 is conventional and includes a stopper 56 which will engage the spout 55 when the lid 42 is pivoted over on top of the cap 40.

The cap 40 is non-cylindrical about its longitudinal axis y—y, that is cap 40 has features which are non-cylindrical with respect to this axis y—y. For example, the dispensing opening 54 and spout 55 are eccentric with respect to the axis y—y. Also, the lid 42 is hinged from the periphery of the cap 40.

Skirt 52 has a pair of 180° helical threads 60 and 62 that are complimentary with the external threads 30 and 32 on the container neck 24. This arrangement facilitates screwing the closure 12 onto the container neck 24. It will be appreciated that other types and sizes of threads can be utilized to accomplish the same purpose.

The internal surface of skirt 52 has a projection 64 spaced by a gap 66 from the internal thread 60. Projection 64 is shown as the terminal end of internal thread 60 spaced from the remainder of internal thread 60 by gap 66. This projection 64, along with hook 34 of thread 32 on container neck 24, form the locking member of the invention.

Figure 2A:
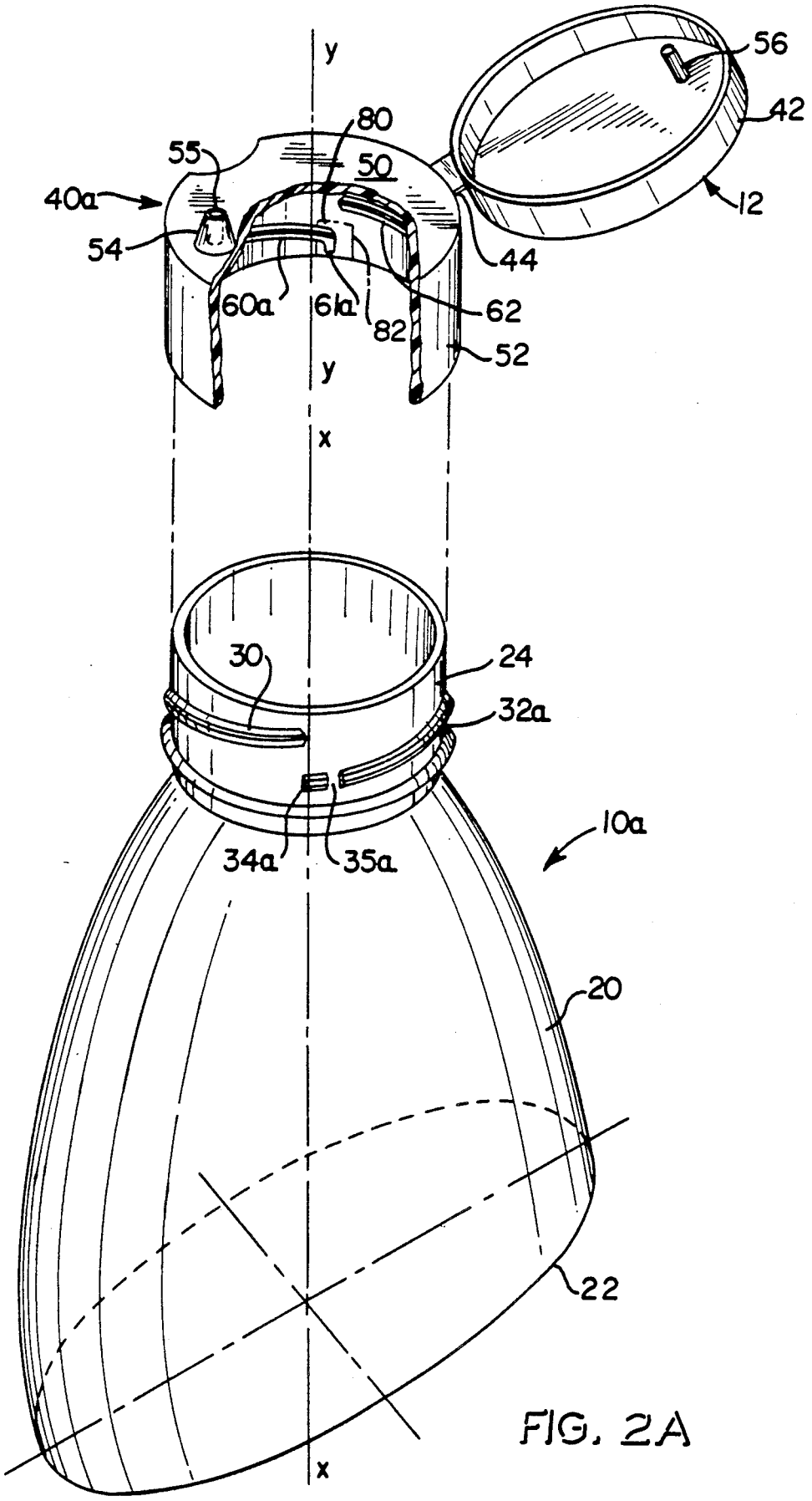
FIG. 2A is an exploded isometric view, partially in section, of an alternate embodiment of the closure system of the invention.
Figure 2B:
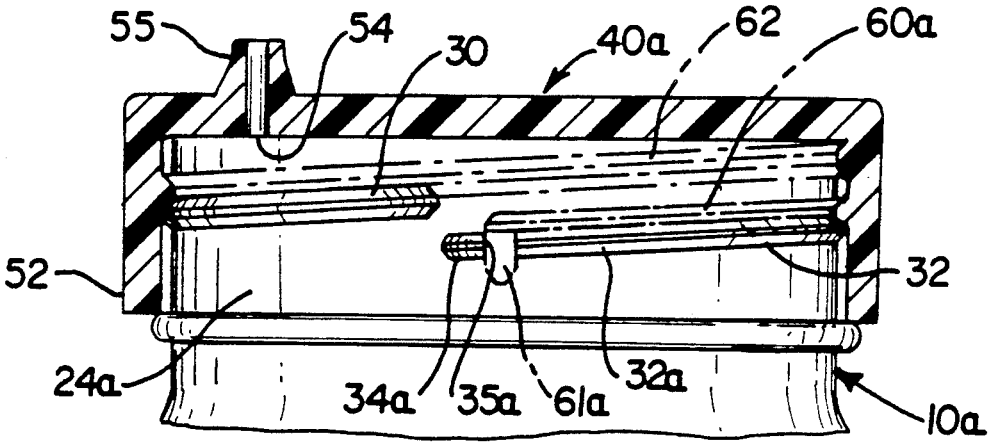
FIG. 2B is a partial vertical section of the closure system of FIG. 2A showing the cap fully secured onto and locked to the container.
Figure 2:
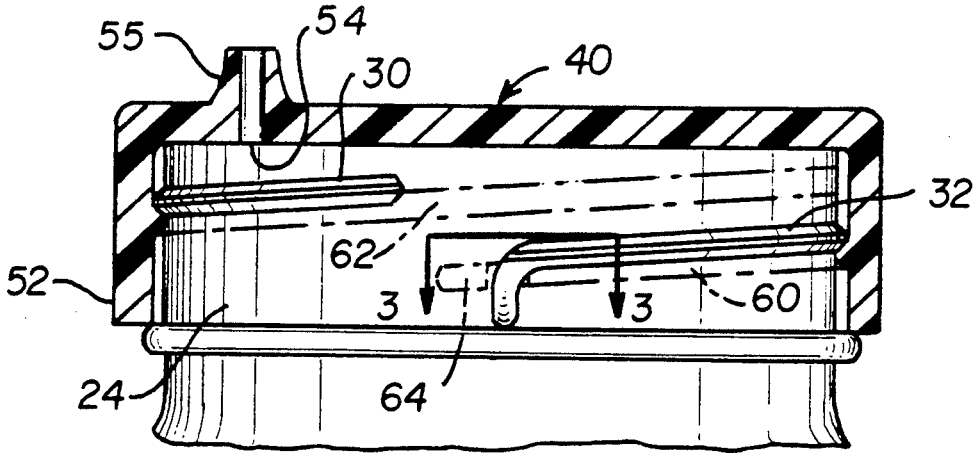
FIG. 2 is a partial vertical section of the closure system showing the cap fully screwed onto and locked to the container.

Referring to FIG. 2, the locking members of the invention will be discussed. FIG. 2 shows the cap 40 (lid 42 is not shown in this view) fully screwed onto container neck 24. Thread 30 is engaged with thread 62 and thread 60 is engaged with thread 32. Hook 34 extends into gap 66 between the projection 64 and thread 60 to lock the cap 40 onto the container neck 24. The locking members (hook 34 and the projection 64) define substantially axially extending engagement surfaces that are engaged when the cap 40 is fully screwed on the container neck 24. The locking members prevent rotation of the cap 40 when an attempt is made to unscrew the cap 40 from the container neck 24.

It will be appreciated that the locking members shown in FIG. 2 can be reversed. That is, the cap can have a thread with a hook that engages a gap in the thread of the container neck. Referring more particularly to FIGS. 2A and 2B, where like parts to those of the embodiment shown in FIGS. 1 and 2 are indicated by like reference characters, cap **40*a* is shown with internal thread 60*a*. Internal thread 60*a* has an integral downwardly projecting hook 61*a* which forms part of the locking member of the invention. Container body 10*a* is shown with external thread 32*a* and projection 34*a* spaced by a gap 35*a* from the external thread 32*a*. Projection 34*a* is shown as the terminal end of internal thread 32*a* spaced from the remainder of internal thread 32*a* by gap 35*a*. Projection 34*a*, along with hook 61*a* of thread 60*a***, form another embodiment of the locking member of the invention.

Referring to FIG. 2B (where like parts to the embodiment shown in FIGS. 1 and 2 are indicated by like numbered reference characters), the locking members of this alternate embodiment of the invention will be discussed. FIG. 2B shows the cap **40*a* fully screwed onto container neck 24*a*. Thread 30 is engaged with thread 62 and thread 60*a* is engaged with thread 32*a*. Hook 61*a* extends into gap 35*a* between the projection 34*a* and thread 32*a* to lock the cap 40*a* onto the container neck 24*a*. The locking members (hook 61*a* and projection 34*a*) define substantially axially extending engagement surfaces that are engaged when the cap 40*a* is fully screwed on the container neck 24*a*. The locking members prevent rotation of the cap 40*a* when an attempt is made to unscrew cap 40*a* from the container neck 24*a***. In fact, the locking members need not be integral with or extensions of their respective threads. That is, the locking members can consist merely of a radially outward projection on the outer surface of the container neck which engages a radially inward projection on the inner surface of the cap such that the cap is locked to the container neck when the cap is fully screwed-onto the container neck.

Figure 3:
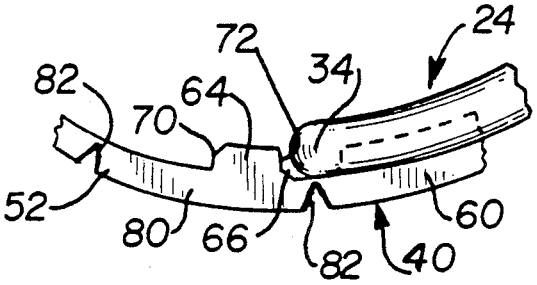
FIG. 3 is a partial horizontal section in enlarged scale taken through line 3—3 of FIG. 2 of the container and the tear out section.

FIG. 3 shows the hook 34 engaged in the gap 66 between the internal thread 60 and the terminal projection of the internal thread 64. The terminal projection 64 has a camming surface 70 and a straight edge 72. The camming surface 70 will allow the projection 64 to cam over hook 34 when screwing the cap 40 onto the container neck 24. On the other hand, the straight edge 72 will prevent the projection from becoming disengaged from hook 34 if an attempt is made to unscrew cap 40 from container neck 24.

The tamper evident aspect of the invention is shown in FIGS. 1 and 3–5. Annular skirt 52 includes a tear out section 80 which is defined by a weakened zone line 82. Weakened zone line 82 can be seen in FIG. 3 as an area of thinness on the annular skirt 52. The tear out section 80 is torn out when an attempt is made to unscrew the cap 40 from the container neck 24 after the cap 40 is fully screwed on the container neck 24. This occurs because terminal projection 64, and hence the tear out section 80, are prevented from rotating with the cap by the hook 34. The resulting relative movement tears the tear out section 80 from the remainder of the skirt at the weakened zone line 82. It will be appreciated that the embodiment in FIGS. 2A and 2B will function in the same manner as the embodiment in FIGS. 1–5.

Figure 4:
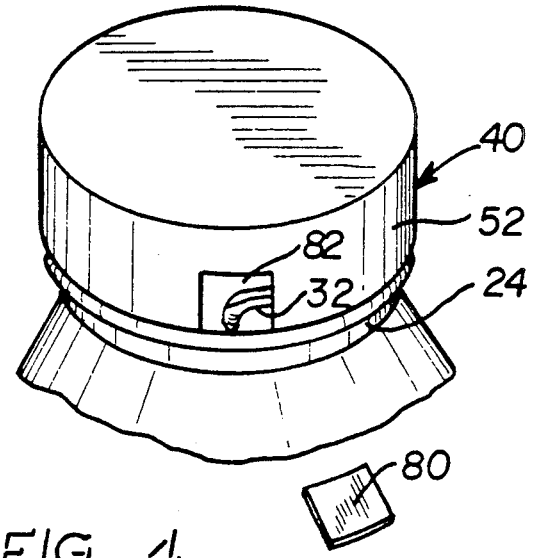
FIG. 4 is a front elevational view of the tear out section being completely separated from the FIG. 5 is an isometric view of the cap showing another embodiment of the tear out section.

Referring to FIG. 4, once the tear out section 80 is torn out, a part of thread 32 on the container neck 24 can be readily observed This will provide a visual indication that an attempt to unscrew the cap 40 from the container neck 24 was made.

Figure 5:
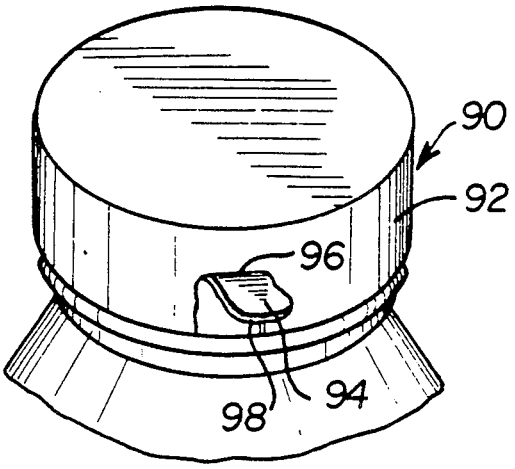

FIG. 5 shows an alternate embodiment of the cap 90 having an annular skirt 92 (container neck not shown) in which the tear out section 94 is only partially torn. The tear out section 94 remains attached to the skirt 92 at a hinge line 96. In this embodiment, the tear out section has an exposed jagged free edge 98 which provides further indication that an attempt was made to unscrew the cap from the container neck.

Another aspect of the invention is that the locking members position the dispensing opening relative to the container in a predetermined position. As shown in FIG. 1, container body 20 has an oval shaped base 22 on a cylindrical neck 24. The container body 20 is non-cylindrical about the longitudinal axis x—x of the container neck. In this instance, it is desired to position the dispensing opening 54, which is eccentrically located in the end wall 52 of the cap 40, such that the contents of container 10 can be dispensed in the most efficient and neatest manner. Also, it is desired to position the hinged lid 42 such that it will not interfere with the contents of the container when the contents are dispensed therefrom.

As used herein, a container which is non-cylindrical about the longitudinal axis of the container neck not only includes non-cylindrical containers (such as oval, square, oblong containers) but also contemplates cylindrical container bodies which have container necks that are offset from the center of the container body.

In addition, if the cap 40 itself is non-cylindrical about its own longitudinal axis, the locking members can also position the cap 40 such that the dispensing opening 54 is placed so that the contents of the container 10 can be dispensed in the most efficient and neatest manner. As used herein, a cap which is non-cylindrical about its own axis includes not only square and oblong shaped caps, but also includes any cap that has eccentrically mounted dispensing openings or any cap having a hinged lid located on the periphery of the skirt of the cap.

Figure 6:
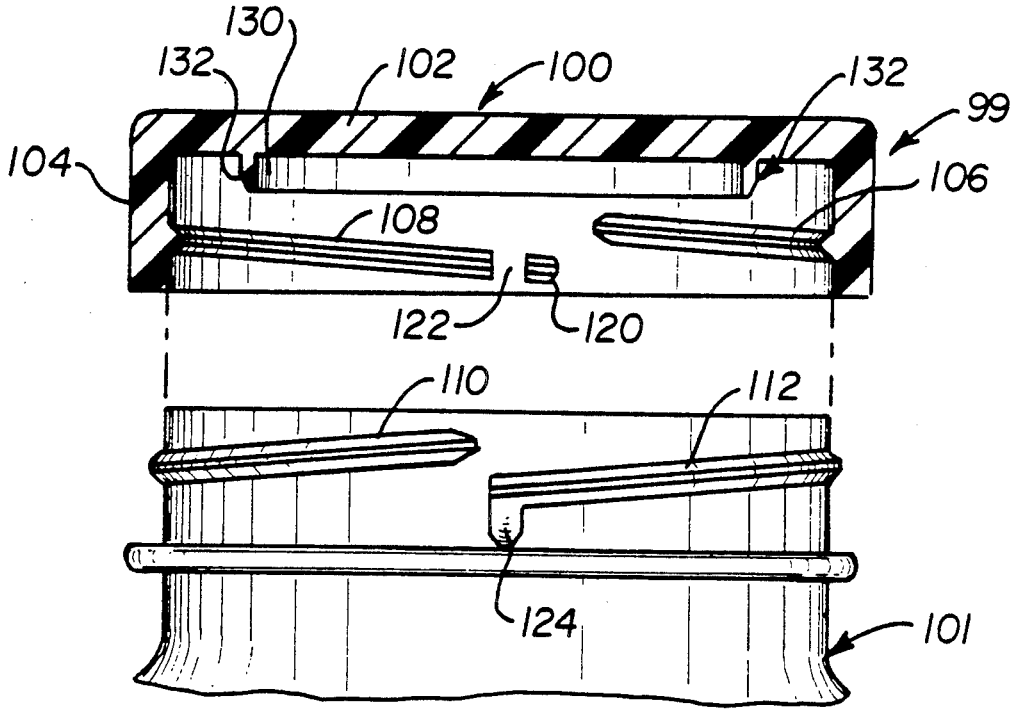
FIG. 6 is an exploded view, partially in section of another embodiment of the closure system of the invention.
Figure 7:
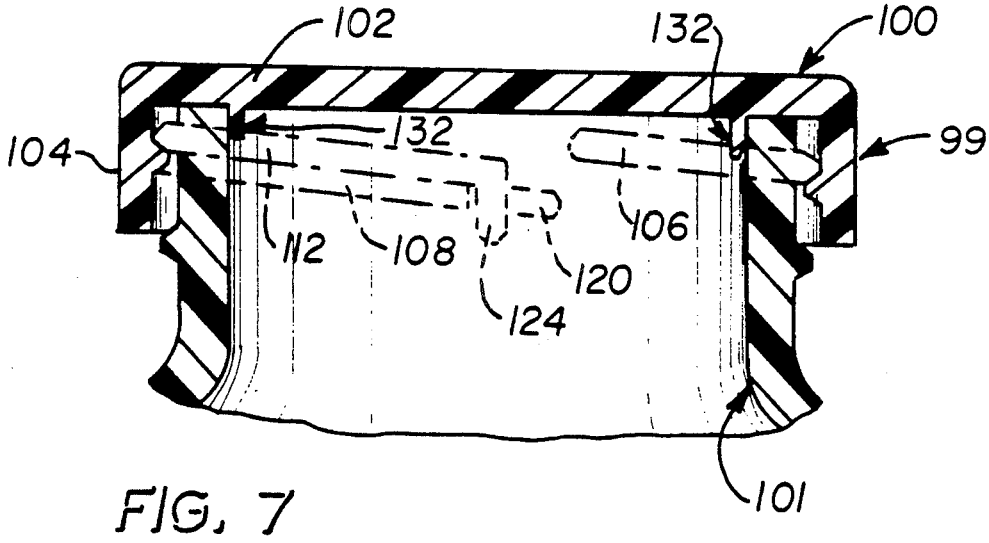
FIG. 7 is a cross-sectional view of the closure system of FIG. 6, showing the cap fully screwed onto and locked to the container neck.
Figure 8:
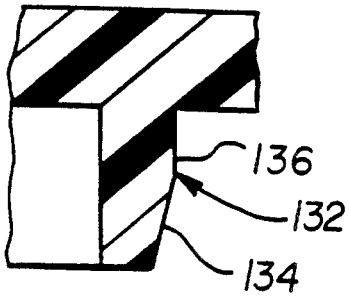
FIG. 8 is a detailed view of the annular rib and sealing means shown in FIG. 7.

An alternative embodiment of the closure system of the invention is shown in FIGS. 6–8. Referring now to FIG. 6, the closure system 99 includes a cap 100 and a container neck 101. The cap 100 has an end wall 102 and an annular skirt 104 extending from the end wall 102. The skirt 104 has a pair of 180° helical threads 106 and 108 that are complimentary with the threads 110 and 112 on the container neck 101.

As was described in relation to FIGS. 1–5, the closure system 99 has locking members which consist of a terminal end 120 spaced from thread 108 to form a gap 122 on the internal surface of annular skirt 104. Complimentary to the locking member on the cap 100 is a locking member on the container neck 101 which consists of a projection in the form of a hook 124 integral with thread 112. As shown in FIG. 7, when the cap 100 is fully screwed onto the container neck 101, the hook 124 will engage into the gap 122 to lock the cap 100 onto the container neck 101.

This embodiment includes a sealing means 130 which is positioned on the underside of end wall 102 to seal the contents of the container in which the closure system 99 is associated. The sealing means is an annular rib 132 which extends radially from the underside of end wall 102. As shown in the detailed view of FIG. 8, the annular rib 132 includes a bevelled lower portion 134 and a straight edge upper portion 136. The bevelled lower portion 134 is designed to locate the seal 132 in the proper position on the opening formed in the container neck, while the straight edge upper portion 136 seats the annular rib 132 and locks the annular rib 132 with the container neck opening.

Although not shown in FIGS. 6–8, it will be appreciated that the tear out section illustrated in FIGS. 4 and 5 can also be included in this embodiment.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

I claim:

1. A closure system comprising:

a container having a container neck with external threads thereon; and a cap having an end wall, an annular skirt extending from said end wall and a dispensing opening extending through said end wall, said skirt including internal threads complementary to the external threads on said container neck for selectively screwing said cap onto said container neck;

said closure system further including cooperating locking members on the outer surface of said container neck and on the inner surface of said skirt, said locking members defining substantially axially extending engagement surfaces that are engaged when said cap is fully screwed on said container and said locking members preventing rotation of said cap when an attempt is made to unscrew said cap from said container neck; and a tear out section on said cap skirt to which the locking member on the cap skirt is secured and which is torn by said locking member on said inner surface of said cap when an attempt is made to unscrew said cap from said container neck after said cap is fully unscrewed on said container neck, whereby a visual indication of said attempt to unscrew said cap from said container is provided; and said locking members are a projection on said outer surface of said container neck and a terminal end of said internal threads on said cap skirt which is spaced apart from the remainder of said internal thread by a gap.

2. The closure system of claim 1, wherein said projection is formed as a hook on the terminal end of said external threads on said container neck, said hook adapted to engage said gap created between said terminal end of said cap skirt internal thread and the remainder of said internal thread.

3. The closure system of claim 2, wherein said tear out section is torn from said cap skirt so that it completely separates from said cap skirt.

4. The closure system of claim 2, wherein said tear out section is only partially torn from said cap skirt so that said tear out section remains attached to said cap skirt along a hinge line, said tear out section having exposed free edges to provide a visual indication that an attempt was made to unscrew said cap from said container neck.

5. The closure system of claim 4, wherein said exposed free edges are jagged to provide a more readily visible indication that an attempt was made to unscrew said cap from said container neck.

6. A closure system comprising:

a container having a container neck with external threads thereon; and a cap having an end wall, an annular skirt extending from said end wall and a dispensing opening extending through said end wall, said skirt including internal threads complementary to the external threads on said container neck for selectively screwing said cap onto said container neck;

said closure system further including cooperating locking members on the outer surface of said container neck and on the inner surface of said skirt, said locking members defining substantially axially extending engagement surfaces that are engaged when said cap is fully screwed on said container and said locking members preventing rotation of said cap when an attempt is made to unscrew said cap from said container neck; and a tear out section on said cap skirt to which the locking member on the cap skirt is secured and which is torn by said locking member on said inner surface of said cap when an attempt is made to unscrew said cap from said container neck after said cap is fully screwed on said container neck, whereby a visual indication of said attempt to unscrew said cap from said container is provided; and said locking members are a terminal end of said container neck external thread which is spaced apart from the remainder of said external thread by a gap and a projection on said inner surface of said cap skirt.

7. The closure system of claim 6, wherein said projection is formed as a hook on the terminal end of said internal threads on said cap skirt, said hook adapted to engage said gap created between said terminal end of said container neck external thread and the remainder of said external

8. The closure system of claim 7, wherein said tear out section is torn from said cap skirt so that it completely separates from said cap skirt.

9. The closure system of claim 7 wherein said tear out section is only partially torn from said cap skirt so that said tear out section remains attached to said cap skirt along a hinge line, said tear out section having exposed free edges to provide a visual indication that an attempt was made to unscrew said cap from said container neck.

10. The closure system of claim 9, wherein said exposed free edges are jagged to provide a more readily visible indication that an attempt was made to unscrew said cap from said container neck.

11. A closure system comprising:

a container having a container neck with external threads thereon; and a cap having an end wall, an annular skirt extending from said end wall and a dispensing opening extending through said end wall, said skirt including internal threads complementary to the external threads on said container neck for selectively screwing said cap onto said container neck;

said closure system further including cooperating locking members on the outer surface of said container neck and on the inner surface of said skirt, said locking members defining substantially axially extending engagement surfaces that are engaged when said cap is fully screwed on said container and said locking members preventing rotation of said cap when an attempt is made to unscrew said cap from said container neck;

a tear out section on said cap skirt to which the locking member on the cap skirt is secured and which is torn by said locking member on said inner surface of said cap when an attempt is made to unscrew said cap from said container neck after said cap is fully screwed on said container neck, whereby a visual indication of said attempt to unscrew said cap from said container is provided; and a lid hinged to said cap adjacent the periphery of said end wall, said lid being pivotable between a closed position which closes said dispensing opening and an open position from which the contents of said container can be disposed.

12. A closure system comprising:

a container having a cylindrical neck with external threads thereon and a container body which is non-cylindrical about the longitudinal axis of said container neck; and a cap which is non-cylindrical about its longitudinal axis and which has an end wall, an annular skirt extending from said end wall and a dispensing opening extending through said end wall, said skirt having an internal cylindrical surface on which internal threads are provided, said internal threads being complementary to the external threads on said container neck for selectively screwing said cap onto said container neck;

said closure system further including cooperating locking members on the outer surface of said container neck and on the inner surface of said skirt, said locking members defining substantially axially extending engagement surfaces that are engaged when said cap is fully screwed on said container, said locking members positioning said dispensing opening relative to said container in a pre-determined position; and said locking members are a projection on said outer surface of said container neck and a terminal end of said internal thread on said cap skirt which is spaced apart from the remainder of said internal thread by a gap.

13. The closure system of claim 12, wherein said projection is formed as a hook on the terminal end of said external threads on said container neck, said hook adapted to engage said gap created between said terminal end of said cap skirt internal thread and the remainder of said internal thread.

14. The closure system of claim 13, including a tear out section on said cap skirt to which the locking member on the cap skirt is secured which is torn by said cap skirt locking member when an attempt is made to unscrew said cap from said container neck after said cap is fully screwed on said container neck, whereby a visual indication of said attempt to unscrew said cap from said container neck is provided.

15. The closure system of claim 14, wherein said tear out section is torn from said cap skirt so that it completely separates from said cap skirt.

16. The closure system of claim 14, wherein said tear out section is only partially torn from said cap skirt so that said tear out section remains attached to said cap skirt along a hinge line, said tear out section having exposed free edges to provide a visual indication that an attempt was made to unscrew said cap from said container neck.

17. The closure system of claim 16, wherein said exposed free edges are jagged to provide a more readily visible indication that an attempt was made to unscrew said cap from said container neck.

18. A closure system comprising:

a container having a cylindrical neck with external threads thereon and a container body which is non-cylindrical about the longitudinal axis of said container neck; and a cap which is non-cylindrical about its longitudinal axis and which has an end wall, an annular skirt extending from said end wall and a dispensing opening extending through said end wall, said skirt having an internal cylindrical surface on which internal threads are provided, said internal threads being complementary to the external threads on said container neck for selectively screwing said cap onto said container neck;

said closure system further including cooperating locking members on the outer surface of said container neck and on the inner surface of said skirt, said locking members defining substantially axially extending engagement surfaces that are engaged when said cap is fully screwed on said container, said locking members positioning said dispensing opening relative to said container in a pre-determined position; and said locking members are a terminal end of said container neck external thread which is spaced apart from the remainder of said external thread by a gap and a projection on said inner surface of said cap skirt.

19. The closure system of claim 18, wherein said projection is formed as a hook on the terminal end of said internal threads on said cap skirt, said hook adapted to engage said gap created between said terminal end of said container neck external thread and the remainder of said external thread.

20. The closure system of claim 19, including a tear out section on said cap skirt to which the locking member on the cap skirt is secured which is torn by said cap skirt locking member when an attempt is made to unscrew said cap from said container neck after said cap is fully screwed on said container neck, whereby a visual indication of said attempt to unscrew said cap from said container neck is provided.

21. The closure system of claim 20, wherein said tear out section is torn from said cap skirt so that it completely separates from said cap skirt.

22. The closure system of claim 20, wherein said tear out section is only partially torn from said cap skirt so that said tear out section remains attached to said cap skirt along a hinge line, said tear out section having exposed free edges to provide a visual indication that an attempt was made to unscrew said cap from said container neck.

23. The closure system of claim 22, wherein said exposed free edges are jagged to provide more readily visible indication that an attempt was made to unscrew said cap from said container neck.

24. A closure system comprising:

a container having a cylindrical neck with external threads thereon and a container body which is non-cylindrical about the longitudinal axis of said container neck; and a cap which is non-cylindrical about its longitudinal axis and which has an end wall, an annular skirt extending from said end wall and a dispensing opening extending through said end wall, said skirt having an internal cylindrical surface on which internal threads are provided, said internal threads being complementary to the external threads on said container neck for selectively screwing said cap onto said container neck;

said closure system further including cooperating locking members on the outer surface of said container neck and on the inner surface of said skirt, said locking members defining substantially axially extending engagement surfaces that are engaged when said cap is fully screwed on said container, said locking members positioning said dispensing opening relative to said container in a predetermined position; and a lid hinged to said cap adjacent the periphery of said end wall, said lid being pivotable between a closed position which closes said dispensing opening and an open position from which the contents of said container can be disposed, said locking members positioning said lid so that said lid will not interfere with the contents from said container when dispensed therefrom.

* * * * *

UNITED STATES PATENT AND TRADEMARK OFFICE

CERTIFICATE OF CORRECTION

PATENT NO. : 5,020,682

DATED : June 4, 1991

INVENTOR(S) : HERBERT V. DUTT

It is certified that error appears in the above-identified patent and that said Letters Patent is hereby corrected as shown below:

Column 2, line 53, after the word "the" insert --cap.--.

Column 4, line 61, after the word "observed" insert --.--.

Signed and Sealed this

Seventh Day of December, 1993

*Attest:*

*Attesting Officer*

Bruce Lehman

BRUCE LEHMAN

*Commissioner of Patents and Trademarks*